United States Patent [19]

Scott

[11] Patent Number: 5,016,515

[45] Date of Patent: May 21, 1991

[54] PRECISE ELECTRONIC AID TO MUSICAL INSTRUMENT TUNING

[75] Inventor: Robert L. Scott, 6384 Crane Rd., Ypsilanti, Mich. 48197

[73] Assignee: Robert L. Scott, Ypsilanti, Mich.

[21] Appl. No.: 604,091

[22] Filed: Oct. 29, 1990

[51] Int. Cl.[5] ..... G10G 1/00

[52] U.S. Cl. ..... 84/454

[58] Field of Search ..... 84/454; 324/79 R

[56] References Cited

U.S. PATENT DOCUMENTS

| | | | |
|---|---|---|---|
| 3,968,719 | 7/1976 | Sanderson | 84/454 |
| 4,014,242 | 3/1977 | Sanderson | 84/454 |
| 4,429,609 | 2/1984 | Warrender | 84/454 |
| 4,732,071 | 3/1988 | Deutsch | 84/454 |

*Primary Examiner*—L. T. Hix
*Assistant Examiner*—Eddie C. Lee

[57] ABSTRACT

An aid to tuning musical instruments. A microprocessor-controlled frequency standard is used to control a shift-register whose data is the digitized sound detected by a microphone. The data from the shift register are loaded into a parallel-load latch and then used to control an array of indicator lights. The pattern in the lights indicates the error in pitch of the sounded note. A person tunes a musical instrument by making the pattern in the lights become nearly stationary. The same synthesized frequency is made available in a speaker.

10 Claims, 3 Drawing Sheets

COMPARISON AND DISPLAY CIRCUIT 17

PRECISE ELECTRONIC AID TO MUSICAL INSTRUMENT TUNING

BACKGROUND OF FIELD OF INVENTION

This invention relates to aids to musical instrument tuning, particularly the tuning of keyboard instruments in the equal-tempered scale.

There are two broad categories of apparatus for tuning musical instruments: reference pitch generators and pitch comparators. A reference pitch generator is a device that produces sound of the correct pitch, such as a set of tuning forks or an electronically controlled frequency generator. A pitch generator, on the other hand is a device that usually provides a visual indication of the pitch of the note that is sounded. (The terms "pitch" and "frequency" are used interchangeably to denote that feature of the sound that is being tuned.)

Using a single tuning fork as a reference pitch generator has been traditionally the most common method of profession piano tuning. After several notes are tuned for a zero-beat with the tuning fork, the remaining notes are then tuned in a special sequence, employing a method know as interval tuning. This method requires considerable skill. It is also susceptible to the effects of cumulative error, which require frequent consistency checks and possible retracting of steps.

Using a large set of tuning forks (e.g., all the notes in one octave) reduces the cumulative error, but it still relies on very precise zero-beats being detected by ear. The same could be said of any reference pitch system, such as an electronically controlled frequency generator. However, a reference pitch generator is useful when tuning a note that is very far from the corrected pitch, such as when new strings are being installed on a piano.

Pitch comparators, on the other hand, can offer a much more accurate evaluation of the pitch of a sound. The best pitch comparators are actually phase comparators. They compare the phase of the sounded note against the phase of an internally generated signal of precise pitch. The rate of change of the phase difference between these two signals is a precise measure of the error in pitch.

The visual means employed to show the phase difference is usually a moving pattern. It is hard to see which way the pattern is moving if it is moving very fast, so phase-sensitive pitch comparators are only useful when the sounded note is too far off from the correct pitch.

In a pitch comparator, the internally generated reference frequency is not usually heard by the person using the device. It is only an electronic signal whose phase is compared against the phase of the sounded note. For example, in the motorized strobe tuners, the reference pitch, or frequency, exists as the rotation rate of the indicator. The sounded note, detected by a microphone, is used to modulate (strobe) a light which shines on the rotating indicator. The relative phase of these two signals is seen as the position of the visible strobe pattern. The rate of movement of the strobe pattern indicates the difference between the two frequencies. The goal is to tune the musical instrument until the visible strobe pattern is nearly stationary.

The motorized indicator in the motorized strobe tuner is bulky, hard to control, and prone to mechanical failure. (A solid state alternative is desirable.) One such device (described in U.S. Pat. No. 4,014,242, issued Mar. 29, 1977 for an "Apparatus for Use in the Tuning of Musical Instruments") uses quadrature reference signals and synchronous demodulation to display the phase comparison in a circle of LEDs. The brightness of each LED represents the degree to which the sounded note is in phase with that particular reference signal. The quadrature signals and their inverses provide a set of four reference signal that are supposed to cover all possible phase conditions. But since there are only four reference phases, poor phase resolution does not permit displaying sounded notes that are harmonically related to the reference note. So this device employs narrow bandpass filters that, together with the reference frequency octave selection, must be adjusted when different octaves are being sounded.

The frequency of the reference signal is the only source of error in a phase-sensitive pitch comparator. In order to achieve the highest accuracy, it is desirable to use precise digital frequency synthesis techniques to generate the reference signal. These techniques usually lock the reference signal to a quartz crystal oscillator using rational number frequency ratios. Unfortunately, the frequencies that comprise equal-tempered tuning are based on irrational number ratios that can only be approximated by rational numbers. To attain excellent accuracy, the whole numbers used in frequency synthesis must be very large. This means that either a very high frequency quartz frequency must be used, or else a very complicated series of whole-number multiplication and division circuits must be applied to the quartz frequency.

Usual frequency synthesis systems rely on fixed division ratios to achieve control of the generated frequency. In such systems, the period of the controlled frequency must be a whole-number multiple of the period of the high-frequency quartz reference signal. This limitation can be overcome by dynamically varying the division ratio so as to achieve a long-term average relationship between the quartz reference and the synthesized frequency. In musical instrument tuning, the average period of the reference signal is much more significant than the instantaneous period of each reference pulse.

Even after very good approximations to the perfect ratios are implemented, there is still the problem of offset adjustment. Usual frequency synthesis techniques do not adapt well to continuous adjustment of the ratios involved. The methods are better suited to "hopping" from one frequency to another. Therefore, most pitch comparators utilizing digital frequency synthesis, nevertheless use analog frequency synthesis to implement pitch scale offsetting. This is sometimes implemented by replacing the quartz oscillator by a variable frequency oscillator. A more accurate method is to use hetrodyning technology to mix a quartz signal with a (low frequency) variable signal. The resultant frequency sum retains much of the quartz signal's accuracy. However, the greater the offset range, the greater the potential frequency error.

BRIEF SUMMARY OF THE INVENTION

Based on the considerations of the prior art, the following are objects of my invention. Both an audible reference pitch and a visual pitch comparison are provided. Harmonically-related notes are displayed without re-adjustment of the device. Pitch comparison is displayed by a phase-sensitive pattern entirely using solid-state technology. All reference frequencies and frequency offsets are digitally synthesized using no variable frequency oscillator.

My invention provides these features through the use of a microprocessor to control the synthesis of a signal that is typically 32 times the frequency of the selected note. This signal is used together with a shift-register display circuit to show a dynamic picture of the sounded note with temporal resolution of 1/32 of a cycle of the selected note in an array of 32 indicator lights. Special considerations are made to accommodate a wide dynamic range in the sound being detected and a complex sound signal (composed of several frequency components).

DESCRIPTION OF THE PREFERRED EMBODIMENT

Figure 1:
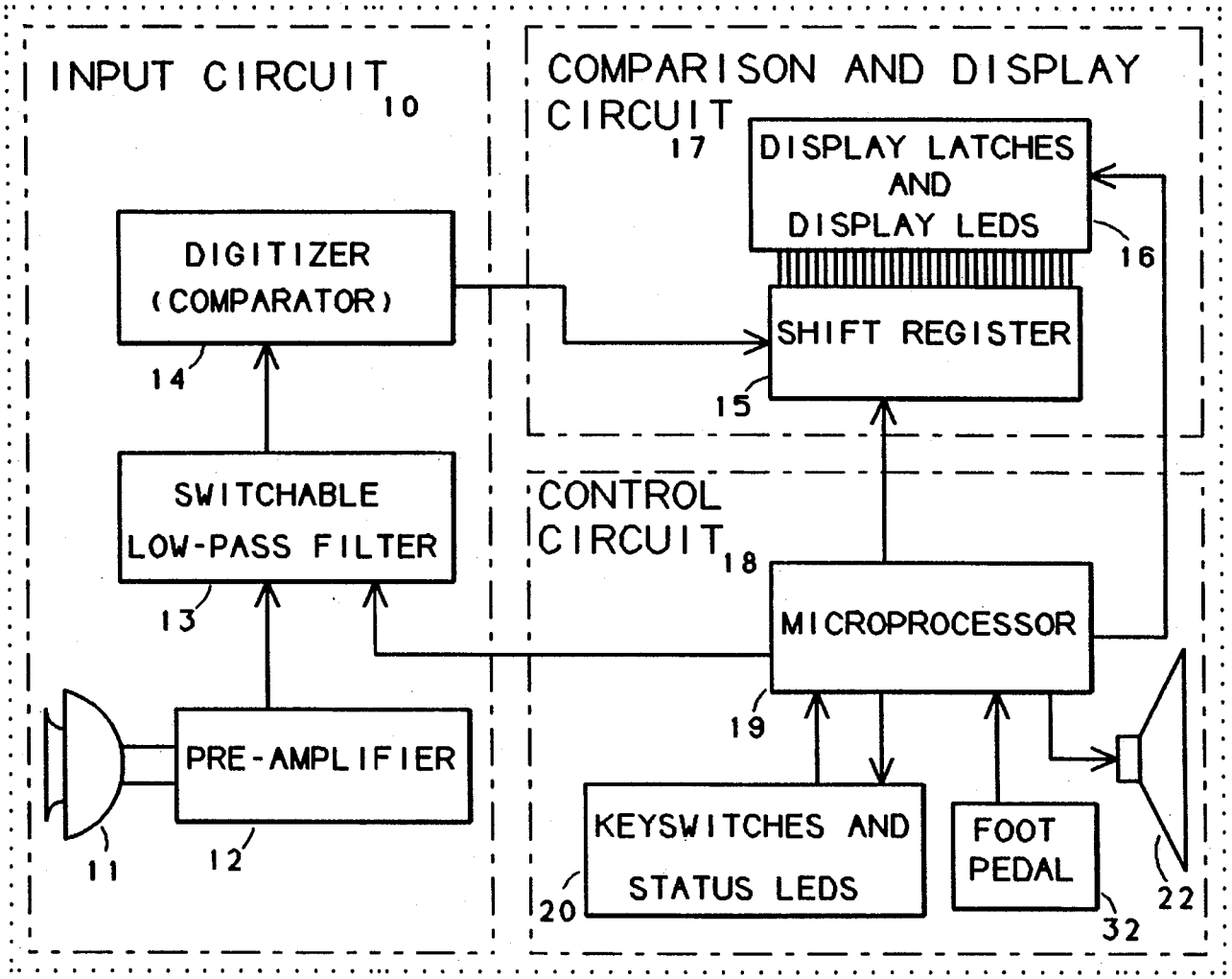
FIG. 1 is block diagram of the tuning aid showing the major function components.
Figure 2:
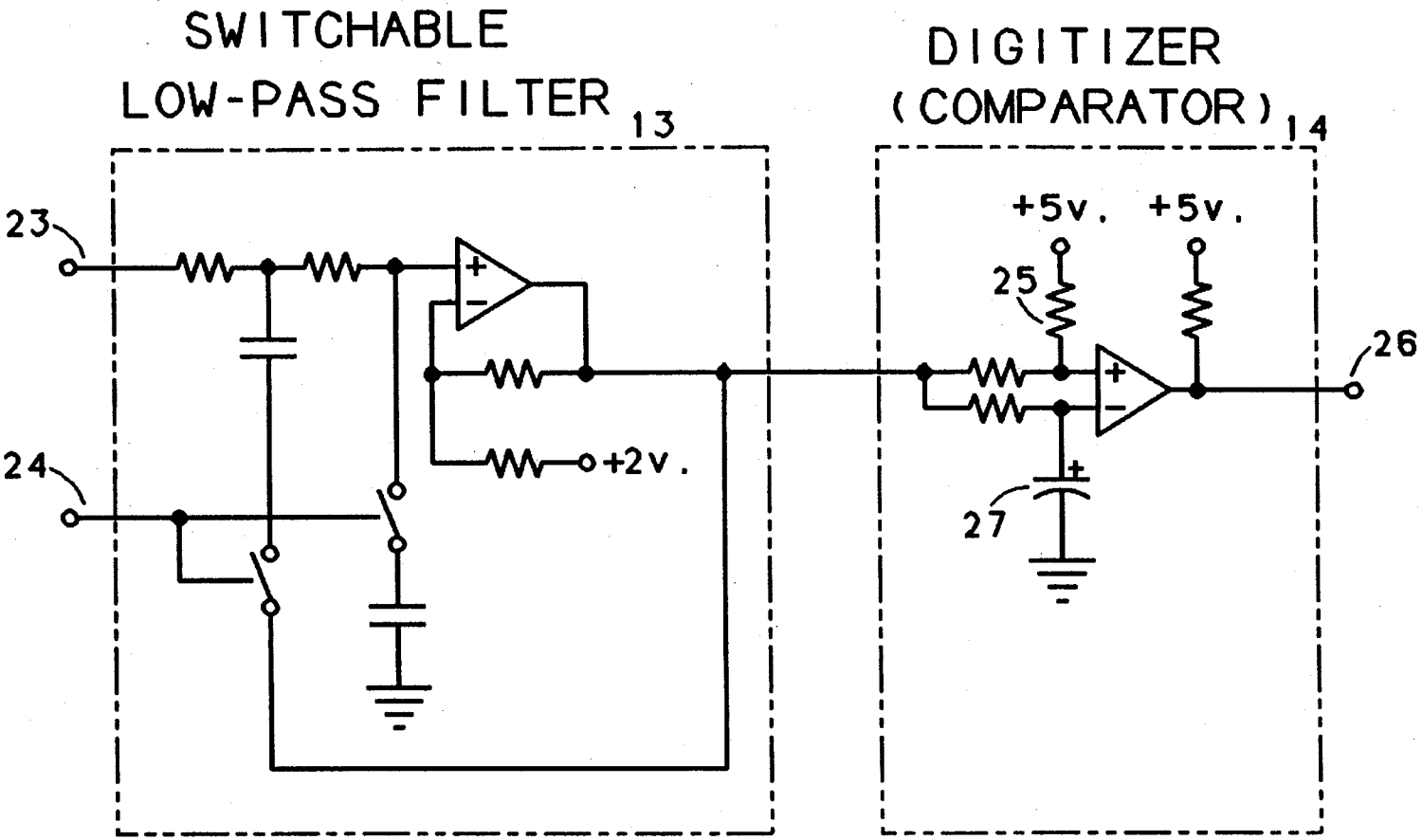
FIG. 2 is a schematic of the analog signal processing portion of the sound detection system.
Figure 3:
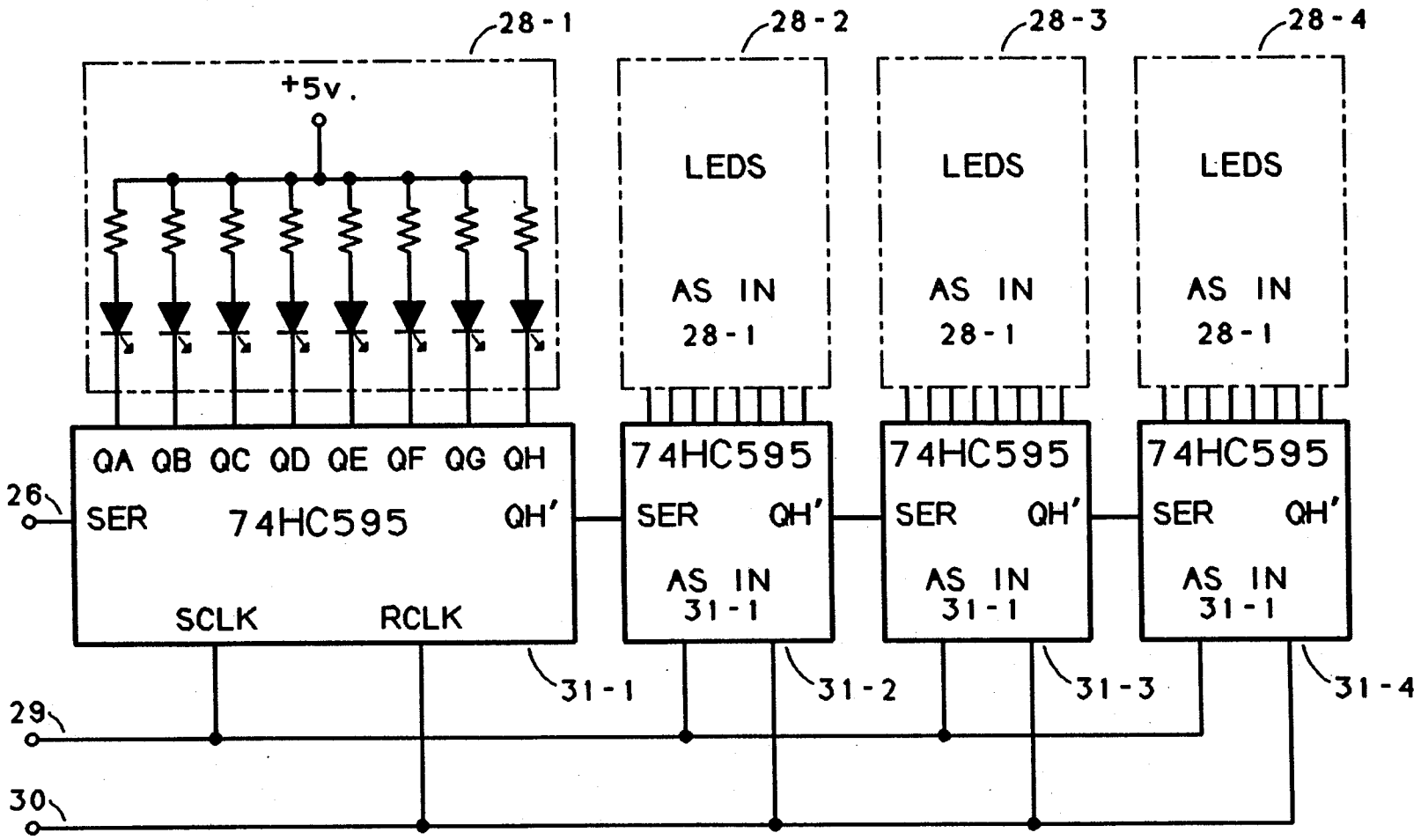
FIG. 3 is a schematic of the shift register and display portion of the tuning aid.

As shown in FIGS. 1, 2, and 3 my tuning aid 21 comprises an audio input circuit 10, a comparison and display circuit 17, and a control circuit 18.

The sound of a musical instrument in sensed by a microphone 11. After being pre-amplified by circuit 13, the microphone signal 23 is processed by an active filter stage 13 that is switchable between flat response and low-pass response, depending on the state of a control signal 24 from the microprocessor 19. The low-pass filter is enabled by the microprocessor when the selected reference note has a frequency below a certain threshold. This threshold is set so as to suppress excessive harmonics when tuning very low notes. This has the effect of clarifying the pattern observed in the array of LEDs 28-1, 28-2, 28-3, 28-4, contained in the circuit display circuit 16.

After being filtered, the microphone signal is digitized by a comparator 14 whose threshold tracks the average value of the signal. This tracking action is accomplished by the charge on the capacitor 27. This charge compensates for DC offsets in previous stages, and causes the pattern in the LEDs to be comprised of about half of the LEDs on and half of them off. The non-filtered leg of the comparator inputs is offset by a high-value resistor 25. This offset has the effect of biasing the threshold so that all LEDs are off when there is very little sound. This action further enhances the clarity of the visual pattern, and saves on battery power as well.

The output 26 of the comparator is a digital signal which is used as the input to a shift register 15. The shift register is clocked by a reference signal 29 generated by the microprocessor. After enough clocks have been sent to the shift register to shift a new data to every stage (32 in this embodiment), the microprocessor sends a load strobe 30 to cause the instantaneous state of all shift register stages to be transferred to the parallel output latches. The shift register and latch functions are implemented in an integrated logic circuit, available commercially as a type "74HC595" 31-1, 31-2, 31-3, 31-4.

These output latches together with the LEDs they control comprise the display latches and display LEDs circuit 16 shown in FIG. 1. The effect of issuing a number of serial-shift clocks followed by a single load strobe is to capture a pattern which represents the instantaneous phase relationship between the digitized microphone signal and the load strobe. The resolution of this phase comparison is determined by the number of shift clocks per load strobe, which is the same as the number of stages in the shift register (32 in this embodiment). If the frequency of the microphone signal and the frequency of the load strobe are near enough to a unison or a harmonic relationship, then the dynamic pattern in the LEDs can be visually observed. The direction and rate of movement of this pattern then gives the comparison between the reference and the input frequencies.

The microprocessor control circuit 18 implements the user interface and the reference frequency generation. The user interface is accomplished through a piano-like keyboard with various other control switches and status LEDs 20, and a speaker 22. The piano-like keyboard serves multiple functions in this embodiment. Its primary function is to select a musical note. The keys also have digits associated with them and they can be used for numeric entry of offsets and frequencies. Some of the keys have special functions associated with them which are used in conjunction with a function control switch. The special functions include direct entry of frequency or frequency offset, requesting a readout of current frequency or offset, and system reset. Status LEDs associated with each key show which note is currently selected. There are also status LEDs showing which octave is currently selected. In addition to its use as an audible reference tone generator, the speaker is used during user interaction to acknowledge keypresses and otherwise provide feedback to the user.

To facilitate sequencing through a chromatic scale, two control panel keyswitches and an external foot pedal switch 21 cause the next note in chromatic sequence to be selected. This permits hands-off operation, when it would be inconvenient to press a keyswitch for every note selection.

As a keyboard selectable option, the speaker 22 is driven by a signal which in synchronous with the load signal 30 to provide an audible reference tone. When the speaker is thus enabled, the visual display is not generally used because the device is being used as a reference pitch generator rather than a pitch comparator.

The means by which this embodiment synthesizes the clock and load frequencies and the optional speaker signal is software timing loops. The microprocessor uses the known execution time of each instruction to measure out periods of time to the nearest microprocessor cycle for clock, load, and speaker signals. To further increase the resolution of the frequency synthesis, the cycle counts are dynamically varied so that the average period of the synthesized signal is not restricted to being a multiple of the microprocessor cycle period. This provides resolution well beyond what is needed for musical instrument tuning, and in fact well beyond what is normally achievable in terms of the accuracy of the quartz crystal oscillator which provides the microprocessor timing.

For any given selected note, the microprocessor software starts with a look-up table of equal-tempered frequencies for twelve notes in one octave. These frequencies are stored in floating point format with a resolution of 32 bits of mantissa. The frequency from the table is them modified by the selected octave and the selected offset (if any) to arrive at the actual desired frequency.

When the timing aid is not servicing the user interface, it is running the frequency synthesis loop. This loop contains a software delay controlled by a loop counter. The value of that loop counter is calculated in order to make the frequency of the synthesis software loop close to the desired frequency. Within the synthesis software loop is a branch that takes one more cycle of time if it goes one way than if it goes the other. A "fine-tuning" parameter controls the average number of time the branch is taken or not taken. This fine-tuning parameter is calculated to make the average synthesis software loop time as close as possible to the desired period. This results in a slight amount of phase jitter in the synthesized signal, which has negligible effect on the visual pattern. At the higher frequencies, however, the jitter is barely audible in the reference tone in the speaker.

In one of its operating modes, the tuning aid varies the two parameters that determine the software synthesis timing according to the state of keyswitches on the control panel. This allows the user to gradually "slide" the synthesized frequency in order to match an external musical note. Means are then provided using the status LEDs to display to the operator the exact offset from standard tuning that the previous "slide" represents. The user may also enter an explicit offset numerically through the keyboard. For non-tempered scales or engineering applications, the user may also enter the desired frequency in Hertz directly, bypassing the note-table look-up.

What is claimed is:

1. A tuning aid for musical instruments comprising:
A. an input circuit with means for detecting an audio signal and generating a digital input signal of said audio signal;
B. a reference circuit for generating a reference load signal whose frequency is controlled, together with another clock signal whose frequency is an exact multiple of the said reference load signal; and
C. a frequency comparison and display circuit comprising:
i. a digital serial shift register, whose serial data input is derived from the said digital input signal, and whose serial shift clock is derived from the said clock signal;
ii. a parallel-load latch whose input is derived from the parallel output of the said digital serial shift register, and whose parallel-load strobe is derived from the said reference load signal; and
iii. a plurality of display means, each display means responsive to one of the parallel outputs of the said parallel-load latch.

2. A tuning aid as recited in claim 1 wherein:
A. each display means includes at least one lamp connected to each output of the parallel-load latch;
B. the combination of said lamps is arranged in a linear display in which a pattern of on and off lamps may be visually detected; and
C. the direction and rate of movement of said pattern is dependent upon the frequency difference between the digital input signal and the reference load signal.

3. A tuning aid as recited in claim 1 wherein:
A. the reference load signal and lock signal are digitally synthesized under the control of a microprocessor;
B. frequencies of said reference load signal and clock signal are digitally locked to a quartz crystal oscillator; and
C. said frequencies are calculated based on a standard equal-tempered musical scale.

4. A tuning aid as recited in claim 2 wherein the input circuit additionally includes an input signal threshold tracking means comprising:
A. a means to cause the digital input signal to have a duty cycle tending to 50% when audio input signal of normal amplitude are being detected; and
B. a means to cause the digital input signal to tend to be in such a state as to turn off all display lamps when audio input signals of very low amplitude are being detected.

5. A tuning aid as recited in claim 3 additionally comprising note selector means wherein:
A. individual notes may be randomly selected by pressing keys on a one-octave keyboard;
B. different octaves may be selected by pressing octave-selection keys on a keyboard;
C. selected notes may be sequenced in a musical chromatic scale by pressing sequence controlling keys on a keyboard; and
D. said sequencing may also be controlled by a remotely-connected foot pedal switch.

6. A tuning aid as recited in claim 5 additionally including within the input circuit a low-pass filter for reducing the response to harmonics, said low-pass filter being automatically switched in when notes below a certain frequency threshold are selected.

7. A tuning aid as recited in claim 6 additionally including means within a microprocessor software to enable the user to enter an offset to the standard equal-tempered musical scale, said offset being used to calculate said frequencies.

8. A tuning aid as recited in claim 7 additionally including means within the microprocessor software to enable the user to enter a selected frequency in Hertz through a keyboard, said frequency being used by the tuning aid in lieu of a computed musical frequency.

9. A tuning aid as recited in claim 8 additionally comprising a means within the microprocessor-controlled frequency synthesis software whereby the periods of the reference load signal and clock signal are varied dynamically in order to achieve a resolution on the average period that is finer than the period of the quartz crystal oscillator.

10. A tuning aid as recited in claim 9 additionally comprising a means within the microprocessor-controlled frequency synthesis software whereby the selected frequency can be varied in real-time by continuously modifying the software parameters that control frequency.

* * * * *